US010260173B2

(12) United States Patent
Zushi et al.

(10) Patent No.: US 10,260,173 B2
(45) Date of Patent: Apr. 16, 2019

(54) CARBON FIBER MANUFACTURING DEVICE AND CARBON FIBER MANUFACTURING METHOD

(71) Applicants: THE UNIVERSITY OF TOKYO, Tokyo (JP); NATIONAL INSTITUTE OF ADVANCED INDUSTRIAL SCIENCE AND TECHNOLOGY, Tokyo (JP)

(72) Inventors: Hiroaki Zushi, Bunkyo-ku (JP); Takaya Suzuki, Bunkyo-ku (JP); Jun-ichi Sugiyama, Tsukuba (JP)

(73) Assignees: TEIJIN LIMITED, Osaka (JP); NATIONAL INSTITUTE OF ADVANCED INDUSTRIAL SCIENCE AND TECHNOLOGY, Tokyo (JP); THE UNIVERSITY OF TOKYO, Tokyo (JP)

( * ) Notice: Subject to any disclaimer, the term of this patent is extended or adjusted under 35 U.S.C. 154(b) by 22 days.

(21) Appl. No.: 15/300,395

(22) PCT Filed: Mar. 26, 2015

(86) PCT No.: PCT/JP2015/059512

§ 371 (c)(1),
(2) Date: Sep. 29, 2016

(87) PCT Pub. No.: WO2015/152019

PCT Pub. Date: Oct. 8, 2015

(65) Prior Publication Data

US 2017/0327974 A1 Nov. 16, 2017

(30) Foreign Application Priority Data

Mar. 31, 2014 (JP) ..... 2014-074899
Mar. 31, 2014 (JP) ..... 2014-074900

(51) Int. Cl.
*D01F 9/32* (2006.01)

(52) U.S. Cl.
CPC ..... *D01F 9/32* (2013.01)

(58) Field of Classification Search
CPC ... D01F 9/12; D01F 9/14; D01F 9/145; D01F 9/15; D01F 9/155; D01F 9/16; D01F 9/17;
(Continued)

(56) References Cited

U.S. PATENT DOCUMENTS

2009/0277772 A1 11/2009 Kaiser et al.
2011/0079505 A1 4/2011 White et al.
2013/0098904 A1* 4/2013 Harada ..... D01F 9/32 219/756

FOREIGN PATENT DOCUMENTS

JP 2009-001468 A 1/2009
JP 2009-533562 A 9/2009
(Continued)

OTHER PUBLICATIONS

International Search Report for PCT/JP2015/059512 dated Jun. 30, 2015 [PCT/ISA/210].

*Primary Examiner* — Daniel McCracken
(74) *Attorney, Agent, or Firm* — Sughrue Mion, PLLC

(57) ABSTRACT

The problem of the present invention is to provide a carbon fiber manufacturing device in which fiber to be carbonized is irradiated with microwaves and thereby heated, wherein the carbon fiber manufacturing device is compact and capable of performing carbonization at atmospheric pressure without requiring an electromagnetic wave absorber or other additives or preliminary carbonization through external heating. This carbon fiber manufacturing device (200) includes: a cylindrical furnace (27) comprising a cylindrical waveguide in which one end is closed, a fiber outlet (27*b*) being formed in the one end of the cylindrical waveguide
(Continued)

and a fiber inlet (27*a*) being formed in the other end of the cylindrical waveguide; a microwave oscillator (21) for introducing microwaves into the cylindrical furnace (27); and a connection waveguide (22) having one end connected to the microwave oscillator (21) side and the other end connected to one end of the cylindrical furnace (27).

17 Claims, 5 Drawing Sheets

(58) Field of Classification Search
CPC ..... D01F 9/18; D01F 9/20; D01F 9/21; D01F 9/22; D01F 9/225; D01F 9/24; D01F 9/245; D01F 9/26; D01F 9/28; D01F 9/30; D01F 9/32; D01F 9/322
See application file for complete search history.

(56) References Cited

FOREIGN PATENT DOCUMENTS

| | | | |
|---|---|---|---|
| JP | 2011-162898 | A | 8/2011 |
| JP | 2013-002767 | A | 1/2013 |
| JP | 2013-231244 | A | 11/2013 |

* cited by examiner

CARBON FIBER MANUFACTURING DEVICE AND CARBON FIBER MANUFACTURING METHOD

CROSS REFERENCE TO RELATED APPLICATIONS

This application is a National Stage of International Application No. PCT/JP2015/059512 filed Mar. 26, 2015 (claiming priority based on Japanese Patent Application Nos. 2014-074899 filed Mar. 31, 2014 and 2014-074900 filed Mar. 31, 2014), the contents of which are incorporated herein by reference in their entirety.

TECHNICAL FIELD

The present invention relates to a carbon fiber manufacturing device for irradiating a fiber to be carbonized with microwaves to carbonize the fiber and a carbon fiber manufacturing method using the carbon fiber manufacturing device.

BACKGROUND ART

A carbon fiber is superior in specific strength and specific elastic modulus than other fibers and is industrially used widely as a reinforcing fiber or the like combined with resin by taking advantage of its lightweight characteristics and excellent mechanical characteristics.

Conventionally, the carbon fiber is manufactured in the following manner. First, a precursor fiber is subject to a pre-oxidation treatment by heating the precursor fiber in heated air at 230 to 260° C. for 30 to 100 minutes. This pre-oxidation treatment causes a cyclization reaction of the acrylic fiber, increases the oxygen binding amount, and produces a pre-oxidation fiber. This pre-oxidation fiber is carbonized, for example, under a nitrogen atmosphere, with use of a firing furnace at 300 to 800° C., and under a temperature gradient (first carbonization treatment). Subsequently, the pre-oxidation fiber is further carbonized under a nitrogen atmosphere, with use of a firing furnace at 800 to 2100° C., and under a temperature gradient (second carbonization treatment). In this manner, the carbon fiber is manufactured by heating the pre-oxidation fiber from an external portion thereof in the heated firing furnace.

In a case of manufacturing the carbon fiber in the above manner, the temperature must be raised gradually over time to avoid insufficient carbonization of an internal portion of the fiber to be carbonized. The firing furnace heating the pre-oxidation fiber from the external portion thereof has a low heat efficiency since the furnace body and the firing environment as well as the fiber to be carbonized are also heated in the firing furnace.

In recent years, manufacturing the carbon fiber by irradiating the fiber to be carbonized with microwaves and thereby heating the fiber is attempted. In heating a substance by means of the microwaves, the substance is heated from the internal portion thereof. Thus, in the case of heating the fiber to be carbonized with use of the microwaves, the internal portion and the external portion of the fiber can be carbonized uniformly, and reduction of manufacturing time for the carbon fiber is expected. In the case of heating the fiber with use of the microwaves, a target to be heated is only the fiber to be carbonized, and a high heat efficiency is thus expected.

Conventionally, as methods for manufacturing a carbon fiber with use of microwaves, methods in Patent Literature 1 to 4 are known. These methods have limitations such as providing a decompression unit for microwave-assisted plasma, adding an electromagnetic wave absorber or the like to a fiber to be carbonized, performing preliminary carbonization prior to heating by means of microwaves, requiring auxiliary heating, and requiring multiple magnetrons and are not suitable for industrial production.

Further, since the carbon fiber has a high radiation coefficient on its surface, it is difficult to sufficiently raise the firing temperature at the time of irradiating the fiber to be carbonized with microwaves and thereby carbonizing the fiber. Thus, in a case of manufacturing the carbon fiber only with irradiation with microwaves, a carbon fiber having a high carbon content rate cannot be obtained.

CITATION LIST

Patent Literatures

Patent Literature 1: JP 2009-533562 W
Patent Literature 2: JP 2013-231244 A
Patent Literature 3: JP 2009-1468 A
Patent Literature 4: JP 2011-162898 A

SUMMARY OF INVENTION

Technical Problem

An object of the present invention is to provide a carbon fiber manufacturing device in which a fiber to be carbonized is irradiated with microwaves and thereby heated, wherein the carbon fiber manufacturing device is compact and capable of performing carbonization at atmospheric pressure without requiring an electromagnetic wave absorber or other additives or preliminary carbonization through external heating. Another problem of the present invention is to provide a carbon fiber manufacturing method for carbonizing the fiber to be carbonized at high speed with use of the carbon fiber manufacturing device.

Solution to Problem

The present inventors have discovered that a fiber to be carbonized can be carbonized sufficiently at atmospheric pressure by irradiating the fiber to be carbonized with microwaves in a cylindrical waveguide. The present inventors have also discovered that a fiber to be carbonized can be carbonized sufficiently at atmospheric pressure without requiring an electromagnetic wave absorber or other additives or preliminary carbonization through external heating by combining a preliminary carbonization furnace constituted by a rectangular waveguide and a carbonization furnace constituted by a cylindrical waveguide.

In manufacturing a carbon fiber, a fiber to be carbonized sequentially changes from an organic fiber (dielectric body) to an inorganic fiber (conductive body). That is, a microwave absorbing characteristic of a heated target gradually changes. The present inventors have discovered that a carbon fiber manufacturing device according to the present invention can manufacture a carbon fiber efficiently even in a case in which the microwave absorbing characteristic of the heated target changes.

The present inventors have further arrived at arranging a cylindrical adiabatic sleeve transmitting microwaves in a cylindrical carbonization furnace to make a fiber to be carbonized travel therein and irradiate the fiber to be carbonized with microwaves. The present inventors have still further discovered that providing a heater on a terminal end side of this adiabatic sleeve can increase the carbon content of a carbon fiber.

Since this adiabatic sleeve transmits microwaves, the fiber to be carbonized traveling therein can be heated directly. The present inventors have still further discovered that, since the adiabatic sleeve shields radiation heat generated by heating and restricts heat dissipation to keep the interior of the adiabatic sleeve at a high temperature, the carbonization speed of the fiber to be carbonized can drastically be improved.

The present inventors have arrived at the present invention based on these discoveries.

Aspects of the present invention solving the above problems are described below. The following [1] to [5] relate to a first embodiment.

[1] A carbon fiber manufacturing device including:

a cylindrical furnace including a cylindrical waveguide in which a first end is closed, a fiber outlet being formed in the first end of the cylindrical waveguide and a fiber inlet being formed in a second end of the cylindrical waveguide;

a microwave oscillator for introducing microwaves into the cylindrical furnace; and a connection waveguide having a first end connected to the microwave oscillator side and a second end connected to a first end of the cylindrical furnace.

The carbon fiber manufacturing device in the above [1] is a carbon fiber manufacturing device including a carbonization furnace using a cylindrical waveguide as a furnace body and irradiating a fiber to be carbonized traveling in the cylindrical waveguide with microwaves at atmospheric pressure.

[2] The carbon fiber manufacturing device according to [1], wherein an electromagnetic distribution in the cylindrical furnace is in a TM mode.

[3] The carbon fiber manufacturing device according to [2], wherein an electromagnetic distribution in the connection waveguide connected to the cylindrical waveguide is in a TE mode and has an electric field component parallel to a fiber traveling direction.

In the carbon fiber manufacturing device in the above [3], an electromagnetic distribution in a cylindrical furnace is in a TM mode and has an electric field component in a parallel direction to a tube axis. Additionally, an electromagnetic distribution in a connection waveguide is in a TE mode and has an electric field component in a perpendicular direction to the tube axis. This connection waveguide is arranged with a tube axis thereof perpendicular to a tube axis of the cylindrical furnace. Thus, both the cylindrical furnace and the connection waveguide have electric field components parallel to a fiber traveling direction.

A carbon fiber manufacturing method using the carbon fiber manufacturing device in the above [1] to [3] include the following [4] and [5].

[4] A carbon fiber manufacturing method including performing carbonization by means of microwave heating having an electric field component parallel to a fiber traveling direction.

The carbon fiber manufacturing method in the above [4] is a carbon fiber manufacturing method in which a fiber to be carbonized is carbonized by means of microwave heating having an electric field component parallel to a traveling direction of the fiber to be carbonized.

[5] A carbon fiber manufacturing method using the carbon fiber manufacturing device according to [1], including:

a fiber supplying process for sequentially supplying a middle carbonized fiber having a carbon content rate of 66 to 72 mass % from the fiber inlet into the cylindrical furnace;

a microwave irradiating process for irradiating the middle carbonized fiber traveling in the cylindrical furnace with microwaves under an inert atmosphere to produce a carbon fiber; and a carbon fiber taking-out process for sequentially taking out the carbon fiber from the fiber outlet.

The carbon fiber manufacturing method in the above [5] is a carbon fiber manufacturing method in which a middle carbonized fiber having a carbon content rate of 66 to 72 mass % is used as a fiber to be carbonized, and in which carbonization is performed in a cylindrical waveguide whose electromagnetic distribution is in a TM mode.

The following [6] to [11] relate to a second embodiment.

[6] A carbon fiber manufacturing device including:

a cylindrical furnace in which at least a first end is closed;

a microwave oscillator for introducing microwaves into the cylindrical furnace; and a microwave-transmissive adiabatic sleeve arranged on a center axis parallel to a center axis of the cylindrical furnace to cause a fiber to be introduced from a first end thereof and to be let out from a second end thereof.

[7] The carbon fiber manufacturing device according to [6], wherein a microwave transmittance of the adiabatic sleeve is 90% or higher at an ambient temperature.

[8] The carbon fiber manufacturing device according to [6], wherein the cylindrical furnace and the microwave oscillator are connected via a connection waveguide connected to the microwave oscillator side at a first end thereof and connected to the cylindrical furnace at a second end thereof.

The carbon fiber manufacturing device in the above [6] to [8] has a microwave-transmissive adiabatic sleeve inserted in a cylindrical furnace. This adiabatic sleeve transmits microwaves, heats a fiber to be carbonized traveling therein, shields radiation heat generated by heating, and restricts heat dissipation to keep the interior of the adiabatic sleeve at a high temperature. Thus, the adiabatic sleeve accelerates carbonization of the fiber to be carbonized.

[9] The carbon fiber manufacturing device according to [6], wherein the cylindrical furnace is a cylindrical waveguide.

[10] The carbon fiber manufacturing device according to [6], wherein a heater is further arranged on the second end side of the adiabatic sleeve.

The carbon fiber manufacturing device in the above [10] is provided with a heater on a side of the adiabatic sleeve on which a fiber is let out. This heater further heats in the adiabatic sleeve a fiber to be carbonized which has been carbonized by irradiation with microwaves.

[11] A carbon fiber manufacturing method using the carbon fiber manufacturing device according to [6], including:

a fiber supplying process for sequentially supplying a middle carbonized fiber having a carbon content rate of 66 to 72 mass % into the adiabatic sleeve;

a microwave irradiating process for irradiating the middle carbonized fiber traveling in the adiabatic sleeve with microwaves under an inert atmosphere to produce a carbon fiber; and a carbon fiber taking-out process for sequentially taking out the carbon fiber from the adiabatic sleeve.

The carbon fiber manufacturing method in the above [11] is a carbon fiber manufacturing method in which a middle carbonized fiber having a carbon content rate of 66 to 72 mass % is used as a fiber to be carbonized and is sequentially carbonized in the adiabatic sleeve.

The following [12] to [18] relate to a third embodiment. The present embodiment is a carbon fiber manufacturing device further including a preliminary carbonization furnace using a rectangular waveguide in addition to the carbon fiber manufacturing device in the above [1] or [6].

[12] A carbon fiber manufacturing device including:

(1) a first carbonization device including a rectangular cylindrical furnace including a rectangular waveguide in which a first end is closed, a fiber outlet being formed in the first end of the rectangular waveguide and a fiber inlet being formed in a second end of the rectangular waveguide, a microwave oscillator for introducing microwaves into the rectangular cylindrical furnace, and a connection waveguide having a first end connected to the microwave oscillator side and a second end connected to a first end of the rectangular cylindrical furnace; and (2) a second carbonization device including the carbon fiber manufacturing device according to [1].

The carbon fiber manufacturing device in the above [12] is a carbon fiber manufacturing device using the carbon fiber manufacturing device in the above [1] to [3] as a second carbonization furnace. In the upstream of the second carbonization furnace, a first carbonization furnace is arranged. The first carbonization furnace is a carbonization furnace using as a furnace body a rectangular waveguide in a TE mode in which an electromagnetic distribution has an electric field component in a direction perpendicular to a fiber traveling direction and irradiating a fiber to be carbonized traveling in the rectangular waveguide with microwaves at atmospheric pressure.

[13] A carbon fiber manufacturing device including:

(1) a first carbonization device including a rectangular cylindrical furnace including a rectangular waveguide in which a first end is closed, a fiber outlet being formed in the first end of the rectangular waveguide and a fiber inlet being formed in a second end of the rectangular waveguide, a microwave oscillator for introducing microwaves into the rectangular cylindrical furnace, and a connection waveguide having a first end connected to the microwave oscillator side and a second end connected to a first end of the rectangular cylindrical furnace; and (2) a second carbonization device including the carbon fiber manufacturing device according to [6].

The carbon fiber manufacturing device in the above [13] is a carbon fiber manufacturing device using the carbon fiber manufacturing device in the above [6] to [10] as a second carbonization furnace. In the upstream of the second carbonization furnace, a first carbonization furnace is arranged.

[14] The carbon fiber manufacturing device according to [12] or [13], wherein the rectangular cylindrical furnace is a rectangular cylindrical furnace provided with a partition plate partitioning an interior of the rectangular cylindrical furnace into a microwave introducing portion and a fiber traveling portion along a center axis thereof, and wherein the partition plate has slits formed at predetermined intervals.

In the carbon fiber manufacturing device in the above [14], the interior of a rectangular waveguide is partitioned into a microwave introducing portion and a fiber traveling portion by a partition plate. Microwaves resonant in the microwave introducing portion are emitted through slits formed in the partition plate to a fiber to be carbonized traveling in the fiber traveling portion. The fiber traveling portion is provided with an electromagnetic distribution generated by microwaves leaking from the microwave introducing portion to the fiber traveling portion through the slits of the partition plate. The leakage amount of microwaves leaking to the fiber traveling portion through the slits of the partition plate increases along with an increase of the carbon content of the fiber to be carbonized.

[15] The carbon fiber manufacturing device according to [12] or [13], wherein an electromagnetic distribution in the furnace of the first carbonization device is in a TE mode, and an electromagnetic distribution in the furnace of the second carbonization device is in a TM mode.

The carbon fiber manufacturing device in the above [15] is a carbon fiber manufacturing device combining a first carbonization furnace using as a furnace body a rectangular waveguide in which an electromagnetic distribution is in a TE mode having an electric field component in a direction perpendicular to a fiber traveling direction and a second carbonization furnace using as a furnace body a cylindrical waveguide in which an electromagnetic distribution is in a TM mode.

[16] The carbon fiber manufacturing device according to [12] or [13], wherein an electromagnetic distribution in the connection waveguide is in a TE mode and has an electric field component parallel to a fiber traveling direction.

The carbon fiber manufacturing device in the above [16] is a carbon fiber manufacturing device in which an electromagnetic distribution in a connection waveguide connected to a cylindrical waveguide is in a TE mode and has an electric field component parallel to a fiber traveling direction. This connection waveguide is arranged with a tube axis thereof perpendicular to a tube axis of the cylindrical furnace. Thus, both the cylindrical furnace and the connection waveguide have electric field components parallel to the fiber traveling direction.

[17] A carbon fiber manufacturing method using the carbon fiber manufacturing device according to [12], including:

(1) a fiber supplying process for sequentially supplying a pre-oxidation fiber from the fiber inlet of the first carbonization furnace into the rectangular cylindrical furnace, a microwave irradiating process for irradiating the pre-oxidation fiber traveling in the rectangular cylindrical furnace with microwaves under an inert atmosphere to produce a middle carbonized fiber having a carbon content rate of 66 to 72 mass %, and a middle carbonized fiber taking-out process for sequentially taking out the middle carbonized fiber from the fiber outlet of the first carbonization furnace; and (2) a fiber supplying process for sequentially supplying the middle carbonized fiber from the fiber inlet of the second carbonization furnace into the cylindrical furnace, a microwave irradiating process for irradiating the middle carbonized fiber traveling in the cylindrical furnace with microwaves under an inert atmosphere to produce a carbon fiber, and a carbon fiber taking-out process for sequentially taking out the carbon fiber from the fiber outlet of the second carbonization furnace.

The carbon fiber manufacturing method in the above [17] is a carbon fiber manufacturing method in which a pre-oxidation fiber is used as a fiber to be carbonized and is carbonized in a rectangular waveguide in which an electromagnetic distribution is in a TE mode having an electric field component in a perpendicular direction to a fiber traveling direction to produce a middle carbonized fiber having a carbon content rate of 66 to 72 mass %, and in which this middle carbonized fiber is further carbonized in a cylindrical waveguide in which an electromagnetic distribution is in a TM mode.

[18] A carbon fiber manufacturing method using the carbon fiber manufacturing device according to [13], including:

(1) a fiber supplying process for sequentially supplying a pre-oxidation fiber from the fiber inlet of the first carbonization furnace into the rectangular cylindrical furnace, a microwave irradiating process for irradiating the pre-oxidation fiber traveling in the rectangular cylindrical furnace with microwaves under an inert atmosphere to produce a middle carbonized fiber having a carbon content rate of 66 to 72 mass %, and a middle carbonized fiber taking-out process for sequentially taking out the middle carbonized fiber from the fiber outlet of the first carbonization furnace; and (2) a fiber supplying process for sequentially supplying the middle carbonized fiber into the adiabatic sleeve, a microwave irradiating process for irradiating the middle carbonized fiber traveling in the adiabatic sleeve with microwaves under an inert atmosphere to produce a carbon fiber, and a carbon fiber taking-out process for sequentially taking out the carbon fiber from the adiabatic sleeve.

The carbon fiber manufacturing method in the above [18] is a carbon fiber manufacturing method in which a pre-oxidation fiber is used as a fiber to be carbonized and is carbonized in a rectangular waveguide in which an electromagnetic distribution is in a TE mode having an electric field component in a perpendicular direction to a fiber traveling direction to produce a middle carbonized fiber having a carbon content rate of 66 to 72 mass %, and in which this middle carbonized fiber is further carbonized in an adiabatic sleeve.

Advantageous Effects of Invention

A carbon fiber manufacturing device according to a first embodiment includes a carbonization furnace constituted by a cylindrical waveguide in which an electromagnetic distribution is in a TM mode. This carbonization furnace can perform carbonization of a fiber to be carbonized quickly in an area of the fiber having a high carbon content rate (specifically, the carbon content rate is 66 mass % or higher).

A carbon fiber manufacturing device according to a second embodiment has an adiabatic sleeve in a furnace. Thus, radiation heat generated by heating a fiber to be carbonized through irradiation with microwaves can be held in the adiabatic sleeve. As a result, carbonization of the fiber to be carbonized is accelerated. In a case in which a heater is provided at a terminal end of the adiabatic sleeve, a carbon fiber carbonized through irradiation with microwaves can be further heated. Accordingly, the quality of the carbon fiber can be further improved. In a case in which a cylindrical waveguide in which an electromagnetic distribution is in a TM mode is used as a furnace body, carbonization of the fiber to be carbonized can be performed further quickly in an area of the fiber having a high carbon content rate (specifically, the carbon content rate is 66 mass % or higher).

A carbon fiber manufacturing device according to a third embodiment has a preliminary carbonization furnace constituted by a rectangular waveguide in which an electromagnetic distribution is in a TE mode. This carbon fiber manufacturing device can perform carbonization of a fiber to be carbonized quickly in an area of the fiber having a low carbon content rate (specifically, the carbon content rate is less than 66 mass %). By combining a carbonization furnace constituted by a rectangular waveguide and a carbonization furnace constituted by a cylindrical waveguide, a carbonization process of a pre-oxidation fiber can be performed only by means of irradiation with microwaves without applying an electromagnetic wave absorber or other additives or external heating to the fiber to be carbonized. Since carbonization can be performed at atmospheric pressure in the carbon fiber manufacturing device according to each of the first to third embodiments, the fiber to be carbonized can be sequentially inserted through an inlet and an outlet formed in the furnace and carbonized.

DESCRIPTION OF EMBODIMENTS

Hereinbelow, a carbon fiber manufacturing device and a carbon fiber manufacturing method using the same according to the present invention will be described in detail with reference to the drawings.

(1) First Embodiment

Figure 1:
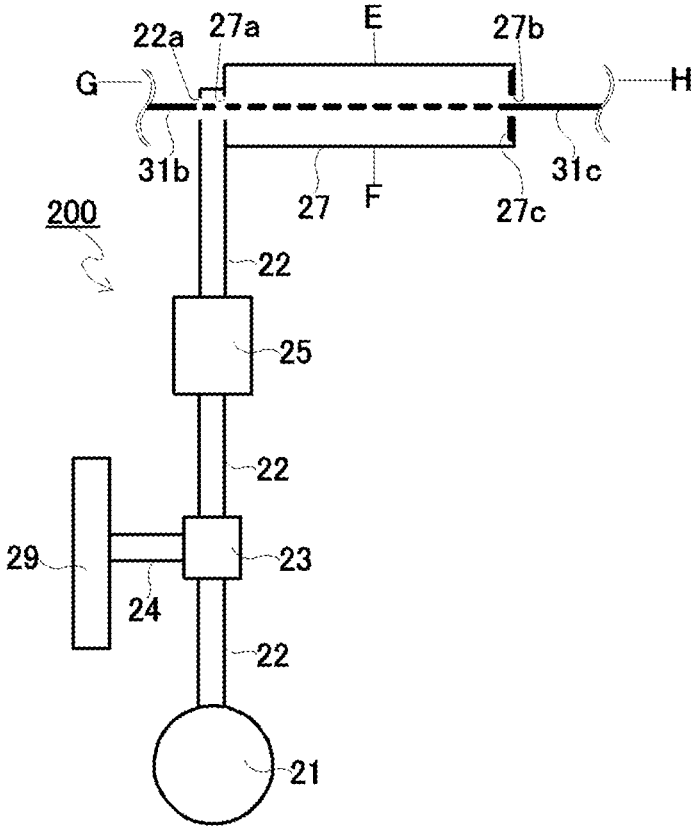
FIG. 1 illustrates a configuration example of a carbon fiber manufacturing device according to a first embodiment of the present invention.

FIG. 1 illustrates a configuration example of a carbon fiber manufacturing device according to a first embodiment of the present invention. In FIG. 1, reference sign 200 refers to a carbon fiber manufacturing device, and reference sign 21 refers to a microwave oscillator. To the microwave oscillator 21, one end of a connection waveguide 22 is connected, and the other end of the connection waveguide 22 is connected to one end of a carbonization furnace 27. In this connection waveguide 22, a circulator 23 and a matching unit 25 are interposed in this order from the side of the microwave oscillator 21.

The carbonization furnace 27 is closed at one end thereof and is connected to the connection waveguide 22 at the other end thereof. The carbonization furnace 27 is a cylindrical waveguide whose cross-section along the line segment E-F is formed in a circular hollow-centered shape. One end of the carbonization furnace 27 is provided with a fiber inlet 27*a* to introduce a fiber to be carbonized into the carbonization furnace while the other end thereof is provided with a fiber outlet 27*b* to take out the carbonized fiber. A short-circuit plate 27*c* is arranged at an inner end portion of the carbonization furnace 27 on the side of the fiber outlet 27*b*. To the circulator 23, one end of a connection waveguide 24 is connected, and the other end of the connection waveguide 24 is connected to a dummy load 29.

Next, operations of this carbon fiber manufacturing device 200 will be described. In FIG. 1, reference sign 31*b* refers to a fiber to be carbonized, and the fiber to be carbonized 31*b* passes through an inlet 22*a* formed in the connection waveguide 22 and is carried into the carbonization furnace 27 from the fiber inlet 27*a* by means of a not-illustrated fiber carrying means. A microwave oscillated by the microwave oscillator 21 passes through the connection waveguide 22 and is introduced into the carbonization furnace 27. The microwave that has reached the carbonization furnace 27 is reflected on the short-circuit plate 27*c* and reaches the circulator 23 via the matching unit 25. The reflected microwave (hereinbelow referred to as "the reflected wave" as well) turns in a different direction at the circulator 23, passes through the connection waveguide 24, and is absorbed in the dummy load 29. At this time, matching is performed between the matching unit 25 and the short-circuit plate 27*c* with use of the matching unit 25, and a standing wave is generated in the carbonization furnace 27. The fiber to be carbonized 31*b* is carbonized by this standing wave and becomes a carbon fiber 31*c*. It is to be noted that, at this time, the interior of the carbonization furnace 27 is at atmospheric pressure and is under an inert atmosphere by means of a not-illustrated inert gas supply means. The carbon fiber 31*c* passes through the fiber outlet 27*b* and is let out of the carbonization furnace 27 by means of the not-illustrated fiber carrying means. By sequentially introducing the fiber to be carbonized into the carbonization furnace 27 from the fiber inlet 27*a*, irradiating the fiber to be carbonized with microwaves in the carbonization furnace 27 to carbonize the fiber, and sequentially letting the fiber out from the fiber outlet 27*b*, the carbon fiber can be manufactured sequentially. The carbon fiber let out from the fiber outlet 27*b* is subject to a surface treatment and a size treatment as needed. The surface treatment and the size treatment may be performed in known methods.

Figure 2:
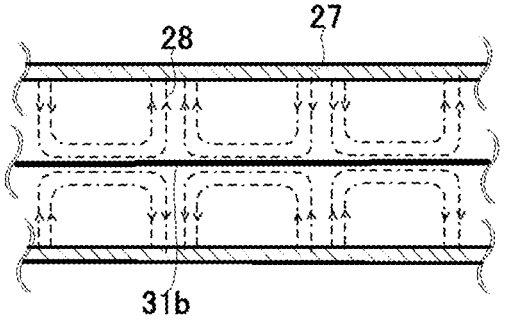
FIG. 2 illustrates an electric field distribution on a cross-section along the line segment G-H in FIG. 1.

The carbonization furnace 27 is constituted by the cylindrical waveguide. The aforementioned microwave is introduced into the carbonization waveguide to cause a TM (Transverse Magnetic)-mode electromagnetic distribution to be formed in the carbonization furnace 27. The TM mode is a transmission mode having an electric field component parallel to a tube axial direction of the waveguide (carbonization furnace 27) and a magnetic field component perpendicular to the electric field. FIG. 2 illustrates an electric field distribution on a cross-section along the line segment G-H. In this carbon fiber manufacturing device, an electric field component 28 parallel to a traveling direction of the fiber to be carbonized 31*b* is formed, and the fiber to be carbonized 31*b* is thereby carbonized. In general, the fiber to be carbonized can be heated more strongly in the TM mode than in a below-mentioned TE mode.

Although the frequency of the microwave is not particularly limited, 915 MHz or 2.45 GHz is generally used. Although the output of the microwave oscillator is not particularly limited, 300 to 2400 W is appropriate, and 500 to 2000 W is more appropriate.

The shape of the cylindrical waveguide used as the carbonization furnace is not particularly limited as long as the TM-mode electromagnetic distribution can be formed in the cylindrical waveguide. In general, the length of the cylindrical waveguide is preferably 260 to 1040 mm and is more preferably a multiple of a resonance wavelength of the microwave. The inside diameter of the cylindrical waveguide is preferably 90 to 110 mm and preferably 95 to 105 mm. The material for the cylindrical waveguide is not particularly limited and is generally a metal such as stainless steel, iron, and copper.

To heat and carbonize the fiber to be carbonized in the TM mode, the carbon content in the fiber to be carbonized is preferably 66 to 72 mass % and more preferably 67 to 71 mass %. In a case in which the carbon content is less than 66 mass %, the fiber to be carbonized is too low in conductivity and easily ruptures when the fiber is heated in the TM mode. In a case in which the carbon content is more than 72 mass %, the conductive fiber to be carbonized existing around the entrance of the carbonization furnace 27 absorbs or reflects microwaves. Thus, introduction of microwaves from the connection waveguide 22 into the carbonization furnace 27 is easily prevented. As a result, since carbonization inside the connection waveguide 22 is accelerated, the degree of progression of carbonization inside the carbonization furnace 27 is lowered, and as a whole, carbonization of the fiber to be carbonized tends to be insufficient.

The carrying speed of the fiber to be carbonized in the carbonization furnace is preferably 0.05 to 10 m/min., more preferably 0.1 to 5.0 m/min., and especially preferably 0.3 to 2.0 m/min.

The carbon content rate of the carbon fiber obtained in this manner is preferably 90 mass % and more preferably 91 mass %.

(2) Second Embodiment

Figure 3:
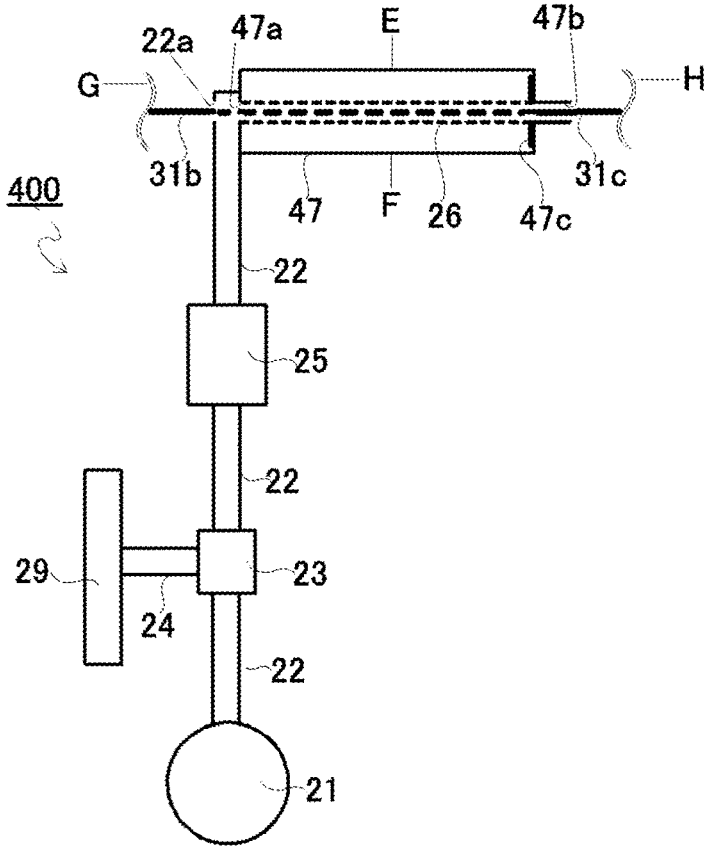
FIG. 3 illustrates a configuration example of a carbon fiber manufacturing device according to a second embodiment of the present invention.

FIG. 3 illustrates a configuration example of a carbon fiber manufacturing device according to a second embodiment of the present invention. In FIG. 3, reference sign 400 refers to a carbon fiber manufacturing device. Identical components to those in FIG. 1 are shown with the same reference signs, and description of the duplicate components is omitted. Reference sign 47 refers to a carbonization furnace. The carbonization furnace 47 is a cylindrical tube closed at one end thereof and connected to the connection waveguide 22 at the other end thereof. In this carbonization furnace 47, an adiabatic sleeve 26 having a center axis parallel to a tube axis of the carbonization furnace 47 is arranged. One end of the adiabatic sleeve 26 is provided with a fiber inlet 47*a* to introduce a fiber to be carbonized into the carbonization furnace while the other end thereof is provided with a fiber outlet 47*b* to take out the carbonized fiber. A short-circuit plate 47*c* is arranged at an inner end portion of the carbonization furnace 47 on the side of the fiber outlet 47*b*.

Next, operations of this carbon fiber manufacturing device 400 will be described. In FIG. 3, reference sign 31*b* refers to a fiber to be carbonized, and the fiber to be carbonized 31*b* passes through the inlet 22*a* formed in the connection waveguide 22 and is carried into the adiabatic sleeve 26 in the carbonization furnace 47 from the fiber inlet 47*a* by means of a not-illustrated fiber carrying means. As with the first embodiment, the fiber to be carbonized 31*b* is carbonized in the carbonization furnace 47 and becomes the carbon fiber 31*c*.

The fiber to be carbonized 31*b* is irradiated with microwaves and is thereby heated. At this time, since the adiabatic sleeve 26 shields radiation heat generated by heating of the fiber to be carbonized 31*b* and restricts heat dissipation, the interior of the adiabatic sleeve 26 is kept at a high temperature. The interior of the adiabatic sleeve 26 is at atmospheric pressure and is under an inert atmosphere by means of a not-illustrated inert gas supply means.

The carbon fiber 31*c* passes through the fiber outlet 47*b* and is let out of the carbonization furnace 47 by means of the not-illustrated fiber carrying means. By sequentially introducing the fiber to be carbonized into the adiabatic sleeve 26 from the fiber inlet 47*a*, irradiating the fiber to be carbonized with microwaves in the adiabatic sleeve 26 to carbonize the fiber, and sequentially letting the fiber out from the fiber outlet 47*b*, the carbon fiber can be manufactured sequentially.

The frequency of the microwave is similar to that in the first embodiment.

The adiabatic sleeve 26 is preferably cylindrical. The inside diameter of the cylindrical adiabatic sleeve 26 is preferably 15 to 55 mm and more preferably 25 to 45 mm. The outside diameter of the adiabatic sleeve 26 is preferably 20 to 60 mm and more preferably 30 to 50 mm. The length of the adiabatic sleeve 26 is not particularly limited and generally 100 to 2500 mm. The material for the adiabatic sleeve 26 needs to be a material transmitting microwaves. The microwave transmittance at an ambient temperature (25° C.) is preferably 90 to 100% and more preferably 95 to 100%. Examples of such a material are mixtures of alumina, silica, magnesia, and the like. Each end of the adiabatic sleeve 26 may be provided with a material absorbing microwaves to prevent leakage of the microwaves.

Figure 5:
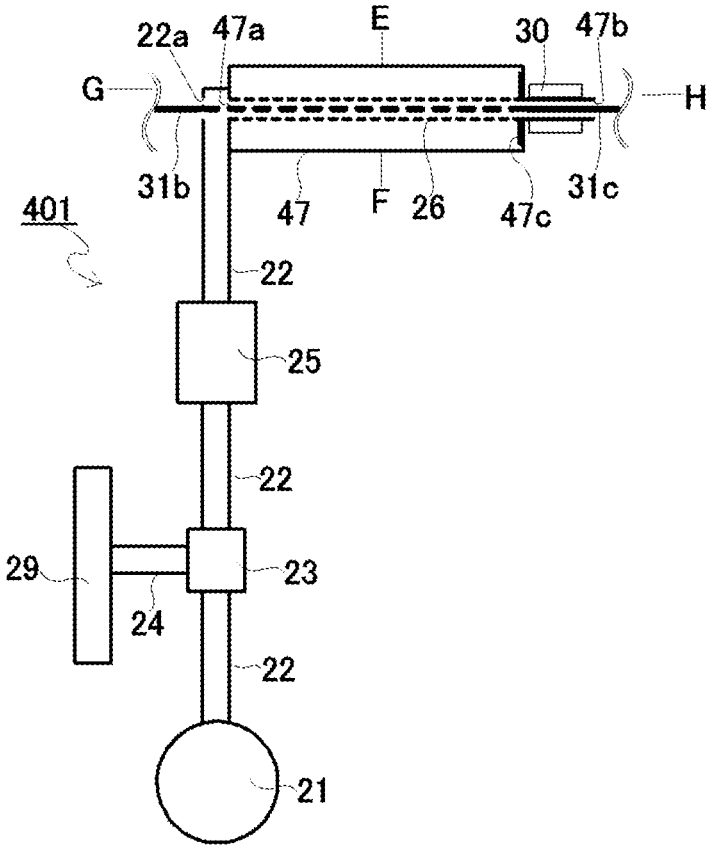
FIG. 5 illustrates another configuration example of a carbon fiber manufacturing device according to the second embodiment of the present invention.

An outer circumferential portion of the adiabatic sleeve 26 on the fiber outlet side, which is a furnace body internal portion or a furnace body external portion of the carbonization furnace 27, is preferably provided with a heater. FIG. 5 illustrates a configuration example of a carbon fiber manufacturing device provided with a heater. In FIG. 5, reference sign 401 refers to a carbon fiber manufacturing device, and reference sign 30 refers to a heater. The heater 30 is arranged at an outer circumferential portion of the adiabatic sleeve 26 on the side of the fiber outlet 47*b* at an external portion of the carbonization furnace 47. The other configuration is similar to that in FIG. 3.

The carbonization furnace 47 is preferably cylindrical. The inside diameter of the cylindrical carbonization furnace 47 is preferably 90 to 110 mm and more preferably 95 to 105 mm. The length of the carbonization furnace 47 is preferably 260 to 2080 mm. The material for the carbonization furnace 47 is similar to that in the first embodiment.

Figure 4:
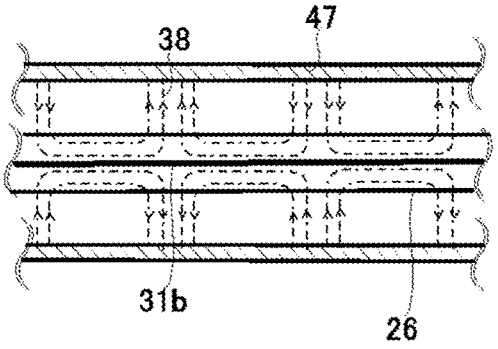
FIG. 4 illustrates an electric field distribution on a cross-section along the line segment G-H in FIG. 1.

As the carbonization furnace 47, a waveguide is preferably used, and a cylindrical waveguide enabling a TM-mode electromagnetic distribution to be formed in the carbonization furnace 47 is more preferably used. The aforementioned microwave is introduced into the carbonization waveguide to cause the TM (Transverse Magnetic)-mode electromagnetic distribution to be formed in the carbonization furnace 47. FIG. 4 illustrates an electric field distribution on a cross-section along the line segment G-H. In this carbon fiber manufacturing device, an electric component 38 parallel to a traveling direction of the fiber to be carbonized 31*b* is formed, and the fiber to be carbonized 31*b* is thereby heated.

The carrying speed of the fiber to be carbonized in the carbonization furnace is similar to that in the first embodiment.

(3) Third Embodiment

Figure 6:
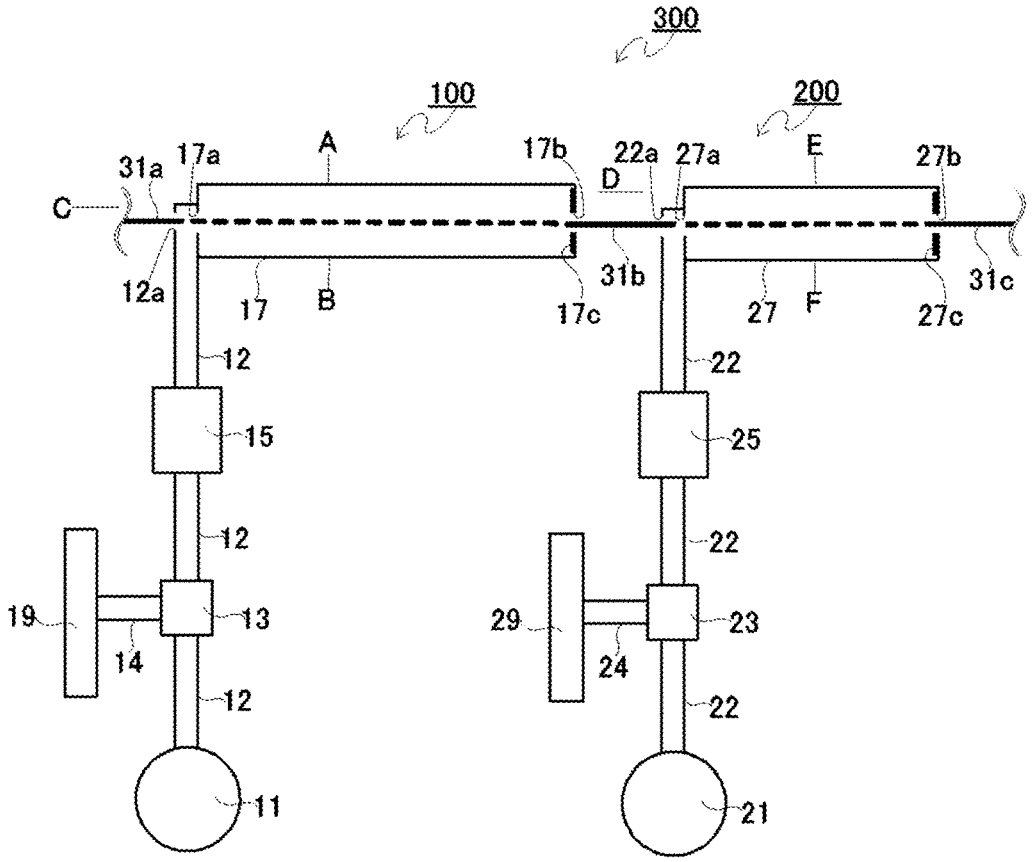
FIG. 6 illustrates a configuration example of a carbon fiber manufacturing device according to a third embodiment of the present invention.

A third embodiment of the present invention is a carbon fiber manufacturing device in which a preliminary carbonization furnace using microwaves is further arranged in the upstream of the carbon fiber manufacturing device according to the above first or second embodiment. FIG. 6 illustrates a configuration example of a carbon fiber manufacturing device in which a preliminary carbonization furnace using microwaves is further arranged in the upstream of the carbon fiber manufacturing device according to the first embodiment. Identical components to those in FIG. 1 are shown with the same reference signs, and description of the duplicate components is omitted. In FIG. 6, reference sign 300 refers to a carbon fiber manufacturing device, and reference sign 100 refers to a first carbonization device. Reference sign 200 refers to a second carbonization device and is equal to the carbon fiber manufacturing device 200 according to the above first embodiment (in the third embodiment, reference sign 200 also refers to "a second carbonization device"). Reference sign 11 refers to a microwave oscillator. To the microwave oscillator 11, one end of a connection waveguide 12 is connected, and the other end of the connection waveguide 12 is connected to one end of a carbonization furnace 17. In this connection waveguide 12, a circulator 13 and a matching unit 15 are interposed in this order from the side of the microwave oscillator 11.

The carbonization furnace 17 is a rectangular waveguide which is closed at both ends thereof and whose cross-section along the line segment A-B is formed in a rectangular hollow-centered shape. One end of the carbonization furnace 17 is provided with a fiber inlet 17*a* to introduce a fiber to be carbonized into the carbonization furnace while the other end thereof is provided with a fiber outlet 17*b* to take out the carbonized fiber. A short-circuit plate 17*c* is arranged at an inner end portion of the carbonization furnace 17 on the side of the fiber outlet 17*b*. To the circulator 13, one end of a connection waveguide 14 is connected, and the other end of the connection waveguide 14 is connected to a dummy load 19.

Next, operations of this carbon fiber manufacturing device 300 will be described. In FIG. 6, reference sign 31*a* refers to a pre-oxidation fiber, and the pre-oxidation fiber 31*a* passes through an inlet 12*a* formed in the connection waveguide 12 and is carried into the carbonization furnace 17 from the fiber inlet 17*a* by means of a not-illustrated fiber carrying means. A microwave oscillated by the microwave oscillator 11 passes through the connection waveguide 12 and is introduced into the carbonization furnace 17. The microwave that has reached the carbonization furnace 17 is reflected on the short-circuit plate 17*c* and reaches the circulator 13 via the matching unit 15. The reflected wave turns in a different direction at the circulator 13, passes through the connection waveguide 14, and is absorbed in the dummy load 19. At this time, matching is performed between the matching unit 15 and the short-circuit plate 17*c* with use of the matching unit 15, and a standing wave is generated in the carbonization furnace 17. The pre-oxidation fiber 31*a* is carbonized by this standing wave and becomes a middle carbonized fiber 31*b*. It is to be noted that, at this time, the interior of the carbonization furnace 17 is at atmospheric pressure and is under an inert atmosphere by means of a not-illustrated inert gas supply means. The middle carbonized fiber 31*b* passes through the fiber outlet 17*b* and is let out of the carbonization furnace 17 by means of the not-illustrated fiber carrying means. The middle carbonized fiber 31*b* is thereafter transmitted to the carbon fiber manufacturing device (second carbonization device) 200 described in the first embodiment, and the carbon fiber 31*c* is manufactured.

Figure 7:
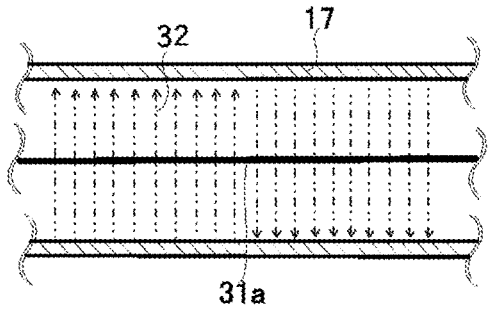
FIG. 7 illustrates an electric field distribution on a cross-section along the line segment C-D in FIG. 6.

The carbonization furnace 17 is constituted by the rectangular waveguide. The aforementioned microwave is introduced into the carbonization waveguide to cause a TE (Transverse Electric)-mode electromagnetic distribution to be formed in the carbonization furnace 17. The TE mode is a transmission mode having an electric field component perpendicular to a tube axial direction of the waveguide (carbonization furnace 17) and a magnetic field component perpendicular to the electric field. FIG. 7 illustrates an electric field distribution on a cross-section along the line segment C-D. In this carbon fiber manufacturing device, an electric field component 32 perpendicular to the fiber to be carbonized 31*a* traveling in the carbonization furnace 17 is formed, and the fiber to be carbonized 31*a* is thereby carbonized.

The shape of the rectangular waveguide used as the carbonization furnace is not particularly limited as long as the TE-mode electromagnetic distribution can be formed in the rectangular waveguide. In general, the length of the rectangular waveguide is preferably 500 to 1500 mm. The aperture of the cross-section orthogonal to the tube axis of the rectangular waveguide preferably has its longer side of 105 to 115 mm and its shorter side of 50 to 60 mm. The material for the rectangular waveguide is not particularly limited and is generally a metal such as stainless steel, iron, and copper.

The frequency of the microwave is one described in the first embodiment. The output of the microwave oscillator of the first carbonization device 100 is not particularly limited, 300 to 2400 W is appropriate, and 500 to 2000 W is more appropriate.

The carbon content in the middle carbonized fiber obtained by heating the pre-oxidation fiber in the TE mode is preferably 66 to 72 mass %. In a case in which the carbon content is less than 66 mass %, the fiber to be carbonized is too low in conductivity and easily ruptures when the fiber is heated in the TM mode in the second carbonization device 200. In a case in which the fiber is heated in the TE mode with the carbon content of over 72 mass %, abnormal heating occurs locally, and the fiber easily ruptures. Further, the conductive fiber to be carbonized existing around the entrance of the carbonization furnace 27 in the second carbonization device 200 absorbs or reflects microwaves, and introduction of microwaves from the connection waveguide 22 into the carbonization furnace 27 is easily prevented. Since carbonization inside the connection waveguide 22 is accelerated, the degree of progression of carbonization inside the carbonization furnace 27 is lowered, and as a whole, carbonization of the fiber to be carbonized tends to be insufficient.

The carrying speed of the fiber to be carbonized in the first carbonization device is preferably 0.05 to 10 m/min., more preferably 0.1 to 5.0 m/min., and especially preferably 0.3 to 2.0 m/min. The carrying speed of the fiber to be carbonized in the second carbonization device is one described in the first embodiment.

Figure 8:
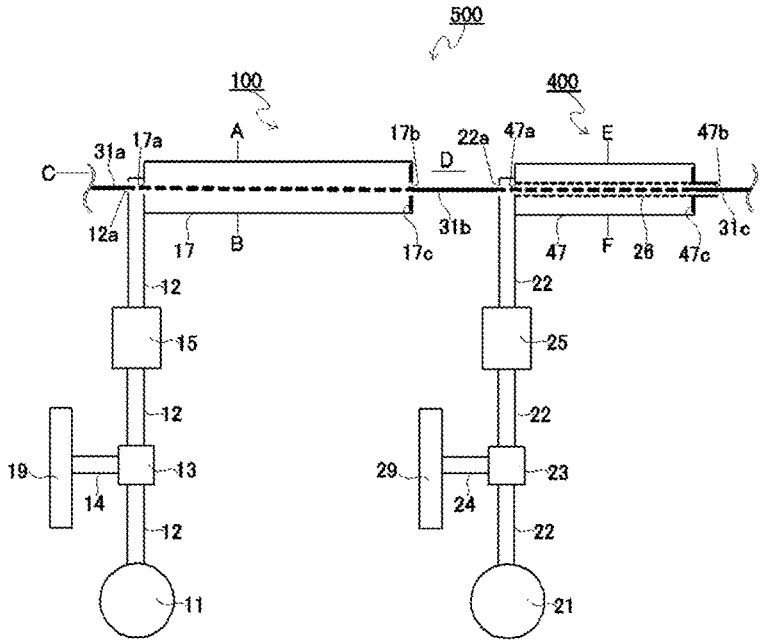
FIG. 8 illustrates another configuration example of a carbon fiber manufacturing device according to the third embodiment of the present invention.

FIG. 8 illustrates a configuration example of a carbon fiber manufacturing device in which a first carbonization device using microwaves is further arranged in the upstream of the carbon fiber manufacturing device according to the second embodiment. Identical components to those in FIGS. 3 and 6 are shown with the same reference signs, and description of the duplicate components is omitted. In FIG. 8, reference sign 500 refers to a carbon fiber manufacturing device, reference sign 100 refers to a first carbonization device, and reference sign 400 refers to the aforementioned carbon fiber manufacturing device 400. Operations of this carbon fiber manufacturing device are similar to those of the carbon fiber manufacturing device 300.

In the first carbonization device 100 of the carbon fiber manufacturing devices 300 and 500 according to the present invention, the interior of the first carbonization furnace 17 is preferably provided with a partition plate partitioning the interior into a microwave introducing portion and a fiber traveling portion along a center axis thereof.

Figure 9:
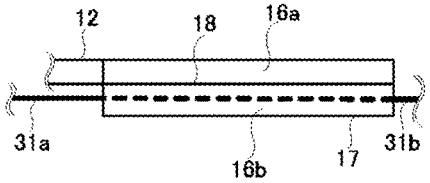
FIG. 9 illustrates another configuration example of a carbonization furnace 17 of a first carbonization device.
Figure 10:
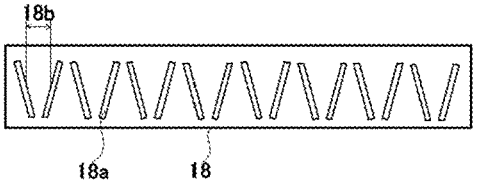
FIG. 10 illustrates a structure of a partition plate 18.

FIG. 9 illustrates another configuration example of the carbonization furnace 17 of the first carbonization device. The interior of the carbonization furnace 17 is provided with a partition plate 18 partitioning the interior into a microwave standing portion 16*a* and a fiber traveling portion 16*b* along a center axis thereof. FIG. 10 illustrates a structure of the partition plate 18. The partition plate 18 is provided with a plurality of slits 18*a* serving as through holes at predetermined intervals. Each of the slits 18*a* functions to leak microwaves from the microwave introducing portion 16*a* to the fiber traveling portion 16*b*. The connection waveguide 12 is connected to the side of the microwave introducing portion 16*a*, and standing waves in the microwave introducing portion 16*a* leak via the slits 18*a* formed in the partition plate 18 to the side of the fiber traveling portion 16*b*. The leakage amount varies depending on the dielectric constant of the fiber traveling in the fiber traveling portion 16*b*. That is, the amount of microwaves to be absorbed in the fiber gradually increases along with progression of carbonization. Thus, carbonization progresses by means of dielectric heating in an initial stage of carbonization of the pre-oxidation fiber 31*a* and by means of resistance heating in a progressed stage of carbonization of the pre-oxidation fiber 31*a*. Accordingly, an irradiation state of microwaves can automatically be changed in accordance with the degree of carbonization of the fiber to be carbonized. Thus, carbonization of the fiber to be carbonized can be performed more efficiently.

A distance 18*b* between center points of the slits is preferably 74 to 148 mm and is preferably a multiple of ½ of a resonance wavelength of the microwave.

EXAMPLES

Hereinbelow, the present invention will be described further in detail by examples. The present invention is not limited to these examples.

In the following examples, a pre-oxidation fiber refers to an oxidized PAN fiber having a carbon content rate of 60 mass %, and a middle carbonized fiber refers to a middle carbonized PAN fiber having a carbon content rate of 66 mass %. As for evaluation of "Carbonization Determination," a case in which the carbon content rate of a carbonized fiber is 90 mass % or higher is graded as ○ while a case in which it is less than 90 mass % is graded as x. As for evaluation of "Process Stability," a case in which the fiber does not rupture during carbonization is graded as ○ while a case in which the fiber ruptures is graded as x. As for "Output" of microwaves, "High" means 1500 W, "Middle" means 1250 W, and "Low" means 1000 W. As for "Carrying Speed Ratio of Fiber to be Carbonized," the ratio when the carrying speed in a conventional method is one time is shown. "Single Fiber Tensile Strength" is determined through a single fiber tensile strength test, and as for evaluation thereof, tensile strength of 3 GPa or higher is graded as ○ while tensile strength of less than 3 GPa is graded as x.

Example 1

The carbon fiber manufacturing device according to the first embodiment (the frequency of the microwave oscillator was 2.45 GHz, and the output was 1200 W) was prepared. As the carbonization furnace, a cylindrical waveguide having an inside diameter of 98 mm, an outside diameter of 105 mm, and a length of 260 mm was used. Microwaves were introduced into the carbonization furnace under a nitrogen gas atmosphere to form a TM-mode electromagnetic distribution. A middle carbonized fiber was made to travel at 0.2 m/min., and was carbonized in this carbonization furnace to produce a carbon fiber. The carbon content rate of the produced carbon fiber was 90 mass %, and no rupture of the fiber was found.

Example 2

The carbon fiber manufacturing device according to the second embodiment (in the first carbonization device, the frequency of the microwave oscillator was 2.45 GHz, and the output was 500 W, and in the second carbonization device, the frequency of the microwave oscillator was 2.45 GHz, and the output was 1200 W) was prepared. As the first carbonization furnace, a rectangular waveguide whose cross-section was formed in a rectangular shape with a longer side of 110 mm and a shorter side of 55 mm, which had a hollow-centered structure, and which was 1000 mm in length was used. In the rectangular waveguide, a partition plate provided with slits having a distance, between center points of the slits, of 74 mm, was arranged to split the interior of the rectangular waveguide into two. As the second carbonization device, a cylindrical waveguide having an inside diameter of 98 mm, an outside diameter of 105 mm, and a length of 260 mm was used. Microwaves were introduced into the carbonization furnace under a nitrogen gas atmosphere to form a TE-mode electromagnetic distribution in the first carbonization furnace and a TM-mode electromagnetic distribution in the second carbonization furnace. A pre-oxidation fiber was made to travel at 0.2 m/min. and was carbonized in the first carbonization device and the second carbonization device in this order to produce a carbon fiber. The carbon content rate of the produced carbon fiber was 93 mass %, and no rupture of the fiber was found.

Comparative Example 1

Carbonization was performed in a similar manner to that in Example 1 except that a rectangular waveguide whose cross-section was formed in a rectangular shape with a longer side of 110 mm and a shorter side of 55 mm, which had a hollow-centered structure, and which was 1000 mm in length was used as the carbonization furnace. The carbon content rate of a produced carbon fiber was 91 mass %, but partial rupture was found in the fiber.

Comparative Example 2

When carbonization was performed in a similar manner to that in Example 1 except that the fiber to be carbonized that was made to travel in the carbonization furnace was changed to a pre-oxidation fiber, a produced fiber ruptured.

Comparative Example 3

Carbonization was performed in a similar manner to that in Example 1 except that a rectangular waveguide whose cross-section was formed in a rectangular shape with a longer side of 110 mm and a shorter side of 55 mm, which had a hollow-centered structure, and which was 1000 mm in length was used as the carbonization furnace, and that the fiber to be carbonized that was made to travel in the carbonization furnace was changed to a pre-oxidation fiber. Carbonization of a produced fiber was insufficient.

Comparative Example 4

Carbonization was performed in a similar manner to that in Example 1 except that a rectangular waveguide whose cross-section was formed in a rectangular shape with a longer side of 110 mm and a shorter side of 55 mm, which had a hollow-centered structure, which was 1000 mm in length, and in which a partition plate provided with slits having a distance, between center points of the slits, of 74 mm, was arranged to split the interior of the rectangular waveguide into two was used as the carbonization furnace. A middle carbonized fiber suitable for being supplied to the second carbonization device was obtained.

Reference Example 1

An electric furnace (heating furnace using no microwaves) was used as the carbonization furnace, and a pre-oxidation fiber was carbonized in a known method to produce a carbon fiber. The carbon content rate of the produced carbon fiber was 95 mass %, and no rupture of the fiber was found.

The results of the above examples are shown in Table 1. When the carbon fiber manufacturing device according to the present invention is used, a carbon fiber having an equivalent carbon content rate to that in a conventional external heating method can be manufactured. As for the manufacturing speed of the carbon fiber, the carbon fiber manufacturing device according to the present invention is three or more times as fast as the conventional carbon fiber manufacturing device.

TABLE 1

| | Heating Method | Electromagnetic Distribution | Fiber to be Carbonized | Carrying Speed of Fiber to be Carbonized (m/min.) | Carbon Content Rate of Carbonized Fiber (mass %) | Carbonization Determination | Process Stability |
|---|---|---|---|---|---|---|---|
| Example 1 | Microwave | TM | Middle Carbonized Fiber | 0.2 | 91 | ○ | ○ |
| Example 2 | Microwave | TE + TM | Pre-oxidation fiber | 0.2 | 93 | ○ | ○ |
| Comparative Example 1 | Microwave | TE | Middle Carbonized Fiber | 0.2 | 91 | ○ | x |

TABLE 1-continued

| | Heating Method | Electromagnetic Distribution | Fiber to be Carbonized | Carrying Speed of Fiber to be Carbonized (m/min.) | Carbon Content Rate of Carbonized Fiber (mass %) | Carbonization Determination | Process Stability |
|---|---|---|---|---|---|---|---|
| Comparative Example 2 | Microwave | TM | Pre-oxidation fiber | 0.2 | — | x | x |
| Comparative Example 3 | Microwave | TE | Pre-oxidation fiber | 0.2 | 63 | — | x |
| Comparative Example 4 | Microwave | TE | Pre-oxidation fiber | 0.2 | 69 | — | ○ |
| Reference Example 1 | External Heating | — | Pre-oxidation fiber | 0.06 | 95 | ○ | ○ |

Reference Example 2

An electric furnace (heating furnace using no microwaves) whose aperture of the cross-section orthogonal to the fiber traveling direction was formed in a rectangular shape with a longer side of 110 mm and a shorter side of 55 mm, which had a hollow-centered structure, and which was 260 mm in furnace length was used as the carbonization furnace, and a middle carbonized fiber was made to travel therein at 0.1 m/min. and was carbonized to produce a carbon fiber. The carbon content rate of the produced carbon fiber was 95 mass %, and no rupture of the fiber was found.

Example 3

The carbon fiber manufacturing device illustrated in FIG. 3 (the frequency of the microwave oscillator was 2.45 GHz) was prepared. As the carbonization furnace, a cylindrical waveguide having an inside diameter of 98 mm, an outside diameter of 105 mm, and a length of 260 mm was used. As the adiabatic sleeve, a cylindrical white porcelain tube having an inside diameter of 35 mm, an outside diameter of 38 mm, and a length of 250 mm (microwave transmittance=94%) was used. Microwaves were introduced into the carbonization furnace under a nitrogen gas atmosphere to form a TM-mode electromagnetic distribution. The output of the microwave oscillator was set to "Low." A middle carbonized fiber was made to travel at 0.3 m/min. and was carbonized in this carbonization furnace to produce a carbon fiber. The carbon content rate of the produced carbon fiber was 91 mass %, and no rupture of the fiber was found. The evaluation result is shown in Table 2.

Examples 4 and 5

In each of Examples 4 and 5, a similar procedure to that in Example 3 was performed except that the output of the microwave oscillator was changed as described in Table 2 to obtain a carbon fiber. The results are shown in Table 2.

Example 6

A similar procedure to that in Example 3 was performed except that the heater was arranged at the outer circumferential portion of the adiabatic sleeve extended 10 cm outward from the fiber outlet to obtain a carbon fiber. The result is shown in Table 2.

Example 7

The carbon fiber manufacturing device illustrated in FIG. 3 (the frequency of the microwave oscillator was 2.45 GHz) was prepared. As the carbonization furnace, a rectangular waveguide was used. The rectangular waveguide was 1000 mm in length, and the size of the aperture of the cross-section orthogonal to the tube axis thereof was 110×55 mm. As the adiabatic sleeve, a cylindrical white porcelain tube having an inside diameter of 35 mm, an outside diameter of 38 mm, and a length of 250 mm was used. Microwaves were introduced into the carbonization furnace under a nitrogen gas atmosphere to form a TE-mode electromagnetic distribution. The output of the microwave oscillator was set to "High." A middle carbonized fiber was made to travel at 0.1 m/min. and was carbonized in this carbonization furnace to produce a carbon fiber. The carbon content rate of the produced carbon fiber was 93 mass %, and no rupture of the fiber was found. The evaluation result is shown in Table 2.

Comparative Examples 5 to 7

In each of Comparative Examples 5 to 7, the same carbon fiber manufacturing device as that in Example 3 was used except that no adiabatic sleeve was provided. A similar procedure to that in Example 3 was performed except that the output of the microwave oscillator was changed as described in Table 2 to obtain a carbon fiber. The results are shown in Table 2.

Comparative Example 8

The same carbon fiber manufacturing device as that in Example 3 was used except that no adiabatic sleeve was provided. A similar procedure to that in Example 3 was performed except that the carrying speed of the middle carbonized fiber was set to 0.1 m/min. to obtain a carbon fiber. The result is shown in Table 2.

Comparative Example 9

The same carbon fiber manufacturing device as that in Example 7 was used except that no adiabatic sleeve was provided, and a similar procedure to that in Example 7 was performed to obtain a carbon fiber. The result is shown in Table 2.

The carbon fiber manufacturing device according to the present invention provided with the adiabatic sleeve can cause the carbon content amount of the fiber to be carbonized to be larger than that in a carbon fiber manufacturing device provided with no adiabatic sleeve. This can accelerate the carrying speed of the carbon fiber and can improve a production efficiency.

TABLE 2

| | Heating Method | Electromagnetic Distribution | Output | Adiabatic Sleeve Provided/Not Provided | Carrying Speed Ratio of Fiber to be Carbonized | Carbon Content Rate of Carbonized Fiber (mass %) | Single Fiber Tensile Strength |
|---|---|---|---|---|---|---|---|
| Reference Example 2 | External Heating | — | — | Not Provided | One Time | 95 | ○ |
| Example 3 | Microwave | TM | Low | Provided | Three Times | 91 | ○ |
| Example 4 | Microwave | TM | Middle | Provided | Three Times | 92 | ○ |
| Example 3 | Microwave | TM | High | Provided | Three Times | 94 | ○ |
| Example 6 | Microwave | TM | High | Provided | Three Times | 95 | ○ |
| Example 7 | Microwave | TE | High | Provided | One Time | 93 | ○ |
| Comparative Example 5 | Microwave | TM | Low | Not Provided | Three Times | 77 | x |
| Comparative Example 6 | Microwave | TM | Middle | Not Provided | Three Times | 78 | x |
| Comparative Example 7 | Microwave | TM | High | Not Provided | Three Times | 82 | x |
| Comparative Example 8 | Microwave | TM | High | Not Provided | One Time | 90 | x |
| Comparative Example 9 | Microwave | TE | High | Not Provided | One Time | 89 | x |

REFERENCE SIGNS LIST

100 . . . first carbonization device (preliminary carbonization device)
200, 400 . . . carbon fiber manufacturing device (second carbonization device)
300, 500 . . . carbon fiber manufacturing device
11, 21 . . . microwave oscillator
12, 14, 22, 24 . . . connection waveguide
12*a*, 22*a* . . . inlet
13, 23 . . . circulator
15, 25 . . . matching unit
16*a* . . . microwave introducing portion
16*b* . . . fiber traveling portion
17, 27, 47 . . . carbonization furnace
17*a* . . . fiber inlet
17*b* . . . fiber outlet
17*c* . . . short-circuit plate
18 . . . partition plate
18*a* . . . slit
18*b* . . . distance between center points of slits
26 . . . adiabatic sleeve
27*a*, 47*a* . . . fiber inlet
27*b*, 47*b* . . . fiber outlet
27*c*, 47*c* . . . short-circuit plate
28 . . . electric field in cylindrical waveguide
19, 29 . . . dummy load
30 . . . heater
31*a* . . . pre-oxidation fiber
31*b* . . . middle carbonized fiber
31*c* . . . carbon fiber
32 . . . electric field in rectangular waveguide
36 . . . electric field in rectangular waveguide
38 . . . electric field in cylindrical waveguide

The invention claimed is:

1. A carbon fiber manufacturing device comprising:

a cylindrical furnace comprising a cylindrical waveguide in which a first end is closed, a fiber outlet being formed in the first end of the cylindrical waveguide and a fiber inlet being formed in a second end of the cylindrical waveguide whose cross-section is formed in a circular hollow-centered shape;

a microwave oscillator for introducing microwaves into the cylindrical furnace for irradiating a fiber to be carbonized traveling in the cylindrical furnace with microwaves; and a connection waveguide having a first end connected to the microwave oscillator side and a second end connected to a first end of the cylindrical furnace.

2. The carbon fiber manufacturing device according to claim 1, wherein an electromagnetic distribution in the cylindrical furnace is in a TM mode.

3. The carbon fiber manufacturing device according to claim 2, wherein an electromagnetic distribution in the connection waveguide connected to the cylindrical waveguide is in a TE mode and has an electric field component parallel to a fiber traveling direction.

4. A carbon fiber manufacturing method comprising performing carbonization by irradiating microwaves having an electric field component parallel to a fiber traveling direction to the fiber to be carbonized traveling in a cylindrical furnace constituted by a cylindrical waveguide whose cross-section is formed in a circular hollow-centered shape.

5. A method of manufacturing carbon fiber with the carbon fiber manufacturing device according to claim 1, comprising:

sequentially supplying a middle carbonized fiber having a carbon content rate of 66 to 72 mass % from the fiber inlet into the cylindrical furnace;

then, irradiating the middle carbonized fiber traveling in the cylindrical furnace with microwaves under an inert atmosphere with the microwave oscillator to produce a carbon fiber;

then, sequentially taking out the carbon fiber from the fiber outlet.

6. A carbon fiber manufacturing device comprising:

a cylindrical furnace comprising a waveguide in which at least a first end is closed;

a microwave oscillator for introducing microwaves into the cylindrical furnace; and an adiabatic sleeve arranged on a center axis parallel to a center axis of the cylindrical furnace to cause a fiber to be introduced from a first end thereof and to be let out from a second end thereof, wherein the carbon fiber manufacturing device is configured to irradiate a fiber to be carbonized traveling in the adiabatic sleeve with microwaves, and a microwave transmittance of the adiabatic sleeve is 90% or higher at an ambient temperature.

7. The carbon fiber manufacturing device according to claim 6, wherein the cylindrical furnace and the microwave oscillator are connected via a connection waveguide connected to the microwave oscillator side at a first end thereof and connected to the cylindrical furnace at a second end thereof.

8. The carbon fiber manufacturing device according to claim 6, wherein the cylindrical furnace is a cylindrical waveguide whose cross-section is formed in a circular hollow-centered shape.

9. The carbon fiber manufacturing device according to claim 6, wherein a heater is further arranged on the second end side of the adiabatic sleeve.

10. A method of manufacturing carbon fiber with the carbon fiber manufacturing device according to claim 6, comprising:

sequentially supplying a middle carbonized fiber having a carbon content rate of 66 to 72 mass % into the adiabatic sleeve;

then, irradiating the middle carbonized fiber traveling in the adiabatic sleeve with microwaves under an inert atmosphere with the microwave oscillator to produce a carbon fiber;

then, sequentially taking out the carbon fiber from the adiabatic sleeve.

11. A carbon fiber manufacturing device comprising:

(1) a first carbonization device including a rectangular cylindrical furnace comprising a rectangular waveguide in which a first end is closed, a fiber outlet being formed in the first end of the rectangular waveguide and a fiber inlet being formed in a second end of the rectangular waveguide whose cross-section is formed in a rectangular hollow-centered shape, a microwave oscillator for introducing microwaves into the rectangular cylindrical furnace for irradiating the fiber to be carbonized traveling in the rectangular cylindrical furnace with microwaves, and a connection waveguide having a first end connected to the microwave oscillator side and a second end connected to a first end of the rectangular cylindrical furnace; and (2) a second carbonization device comprising the carbon fiber manufacturing device according to claim 1.

12. A carbon fiber manufacturing device comprising:

(1) a first carbonization device including a rectangular cylindrical furnace comprising a rectangular waveguide in which a first end is closed, a fiber outlet being formed in the first end of the rectangular waveguide and a fiber inlet being formed in a second end of the rectangular waveguide whose cross-section is formed in a rectangular hollow-centered shape, a microwave oscillator for introducing microwaves into the rectangular cylindrical furnace for irradiating the fiber to be carbonized traveling in the rectangular cylindrical furnace with microwaves, and a connection waveguide having a first end connected to the microwave oscillator side and a second end connected to a first end of the rectangular cylindrical furnace; and (2) a second carbonization device comprising the carbon fiber manufacturing device according to claim 6.

13. The carbon fiber manufacturing device according to claim 11, wherein the rectangular cylindrical furnace is a rectangular cylindrical furnace provided with a partition plate partitioning an interior of the rectangular cylindrical furnace into a microwave introducing portion and a fiber traveling portion along a center axis thereof, and wherein the partition plate has slits formed at predetermined intervals.

14. The carbon fiber manufacturing device according to claim 11, wherein an electromagnetic distribution in the furnace of the first carbonization device is in a TE mode, and an electromagnetic distribution in the furnace of the second carbonization device is in a TM mode.

15. The carbon fiber manufacturing device according to claim 11, wherein an electromagnetic distribution in the connection waveguide is in a TE mode and has an electric field component parallel to a fiber traveling direction.

16. A method of manufacturing carbon fiber with the carbon fiber manufacturing device according to claim 11, comprising:

(1) sequentially supplying a pre-oxidation fiber from the fiber inlet of the first carbonization furnace into the rectangular cylindrical furnace, then, irradiating the pre-oxidation fiber traveling in the rectangular cylindrical furnace with microwaves under an inert atmosphere with the microwave oscillator to produce a middle carbonized fiber having a carbon content rate of 66 to 72 mass %, then, sequentially taking out the middle carbonized fiber from the fiber outlet of the first carbonization furnace; and (2) sequentially supplying the middle carbonized fiber from the fiber inlet of the second carbonization furnace into the cylindrical furnace, then, irradiating the middle carbonized fiber traveling in the cylindrical furnace with microwaves under an inert atmosphere with the microwave oscillator to produce a carbon fiber, then, sequentially taking out the carbon fiber from the fiber outlet of the second carbonization furnace.

17. A method of manufacturing carbon fiber with the carbon fiber manufacturing device according to claim 12, comprising:

(1) sequentially supplying a pre-oxidation fiber from the fiber inlet of the first carbonization furnace into the rectangular cylindrical furnace, then, irradiating the pre-oxidation fiber traveling in the rectangular cylindrical furnace with microwaves under an inert atmosphere with the microwave oscillator to produce a middle carbonized fiber having a carbon content rate of 66 to 72 mass %, then, sequentially taking out the middle carbonized fiber from the fiber outlet of the first carbonization furnace; and (2) sequentially supplying the middle carbonized fiber into the adiabatic sleeve, then, irradiating the middle carbonized fiber traveling in the adiabatic sleeve with microwaves under an inert atmosphere with the microwave oscillator to produce a carbon fiber, then, sequentially taking out the carbon fiber from the adiabatic sleeve.

* * * * *